US006796617B2

(12) United States Patent
Black

(10) Patent No.: US 6,796,617 B2
(45) Date of Patent: Sep. 28, 2004

(54) PERDURABLE COMPOSITE CYLINDER

(75) Inventor: T. Edward Black, 1127 Miller La., Buffalo Grove, IL (US) 60089-4244

(73) Assignee: T. Edward Black, Buffalo Grove, IL (US)

( * ) Notice: Subject to any disclaimer, the term of this patent is extended or adjusted under 35 U.S.C. 154(b) by 0 days.

(21) Appl. No.: 10/321,414

(22) Filed: Dec. 18, 2002

(65) Prior Publication Data

US 2004/0119328 A1 Jun. 24, 2004

(51) Int. Cl.[7] ..... B60B 7/24

(52) U.S. Cl. ..... 301/5.306; 301/5.304; 152/323

(58) Field of Search ..... 301/5.301, 5.306, 301/5.307, 5.309, 5.7; 152/323, 324, 393, 394

(56) References Cited

U.S. PATENT DOCUMENTS 1,867,438 A * 7/1932 Baeck ..... 152/246
2,145,343 A * 1/1939 Dempsey ..... 198/326
2,262,714 A * 11/1941 Ware ..... 301/5.307
2,586,051 A * 2/1952 Jezek ..... 152/323
2,664,317 A * 12/1953 Thomas et al. ..... 301/5.309
3,066,716 A * 12/1962 Fishman ..... 152/323
3,837,662 A * 9/1974 Marks et al. ..... 280/11.223
3,895,844 A * 7/1975 Merbler ..... 301/5.7
4,218,098 A * 8/1980 Burton ..... 301/5.7
4,944,563 A * 7/1990 Pinchbeck et al. ..... 301/64.303
5,211,213 A * 5/1993 Hicks ..... 152/323
5,251,965 A * 10/1993 Johnson ..... 301/64.303
5,542,752 A * 8/1996 Quaglia ..... 301/64.702
5,632,829 A * 5/1997 Peterson et al. ..... 152/165
5,853,226 A * 12/1998 Lee ..... 301/5.309
6,131,923 A * 10/2000 Miotto ..... 280/11.223
6,227,622 B1 * 5/2001 Roderick et al. ..... 301/15.304

* cited by examiner

*Primary Examiner*—Russell D. Stormer
(74) *Attorney, Agent, or Firm*—T. Edward Black

(57) ABSTRACT

A perdurable composite roller skating cylinder and methodology of making the same from low cost readily available commoditized commercial parts. In the in-line roller skating embodiment the cylinder will provide the combine features of long wear life, shock absorption and smooth running through the use of a rigid nylon core or equivalent and an appropriate longitudinal section of flexible polyurethane tubing or equivalent. This embodiment will permit flexure of the outer periphery of the perdurable composite cylinder in response to forces at the outer surface of the cylinder where it contacts the skating terrain surface. As the perdurable composite cylinder provides superior transverse angle joint support and unique cushioning for the foot. These composite cylinder attributes in an in-line skate embodiment will support an expanded dynamic roller skating maneuver repertoire.

1 Claim, 1 Drawing Sheet

PERDURABLE COMPOSITE CYLINDER

BACKGROUND OF THE INVENTION

In prior art, the designs of wheels for roller skates, have primarily aimed at providing a wheel which would allow the roller skating community to emulate the blade of an ice skate. Embodiments of this type are disclosed for example in U.S. Pa. Nos. 3,837,662 and 6,131,923. Thereby availing the performance repertoire of the ice skating community to the roller skating community. While the goal is laudable the results have always been short of the goal. Because the dynamic ambulatory conditions between a hard metal blade sliding against a smooth ice surface and a resilient plastic wheel rolling against a rough wooden floor are entirely different. The extent of this fundamental difference has up to now assigned roller skating to a very minor position in the eclectic skating world.

An alternative approach to the aforementioned are the example embodiments of U.S. Pat. Nos. 3,895,844 and 4,218,098. Although these wheels provide the essential transverse support to the ankle joint, they are mounted to the skating frame and truck in a flexible dual cantilever design. As deflection of a cantilever beam is exponentially related to the applied force, and their are four cantilever mounted wheels attached to each foot. The roller skater is therefore perpetually in an unstable dynamic ambulatory state. Thus the skater is denied a stable dynamic platform from which to launch into and land from versatile aerial vertiginous jumps. This limitation means that a roller skater's access to the ice skating dynamic maneuver repertoire is severely limited.

Another critical unappreciated factor in the design of wheels for roller skates is that when the ankle joint has adequate transverse support and the rolling contact surface is concentrated in a single roller the range of motion of the foot can control how much of the contact surface is required for a given dynamic skating maneuver. And when this intuitive dexterous decision is aided by an isolation barrier within the covering of the skating contact roller, then the skater can utilize the inner half of the toe rollers for spinning and the whole surface for succesefully initialing and terminating various aerial vertiginous roller skating maneuvers. Such roller skating wheels in an in-line configuration will greatly increase the access that the roller skating community, has to the ice skating dynamic maneuver repertoire.

BRIEF SUMMARY OF THE INVENTION

The present invention relates to wheels which are adapted to be used in roller skates, and particularly to roller apparatus which may be subjected to variable loads and shock forces. Like those encountered in executing the standard and expanded roller skating dynamic maneuver repertoire.

The primary object of this present invention is to provide a roller skating wheel that can be fabricated from low cost standard commercial parts, such as polyurethane tubing for the covering and nylon for the core, and yet provide an extended range of desirable operational advantages.

The wheel core has a groove at the longitudinal mid point which causes a diametrical concave point in the core's covering.

The present invention provides support for each end of the shaft of the core's encased ball bearings. This along with combining the rolling contact surface into a single surface at each contact point produces a stable dynamic ambulatory platform from which an expanded roller skating performance repertoire may be executed.

Along with the benefits of low cost and extended wheel covering wear life. It is a further object of the present invention is to provide a roller skate wheel which is easy to manufacture, assemble and to install in an in-line skate frame.

BRIEF DESCRIPTION OF THE SEVERAL VIEWS OF THE DRAWING

Further characteristics and advantages will become apparent from the following detailed description of a preferred but not exclusive embodiment of a wheel for in-line skates. Illustrated only by way of non-limitative example in the accompanying drawing, wherein.

DETAILED DESCRIPTION OF THE INVENTION

Figures 1, 2:
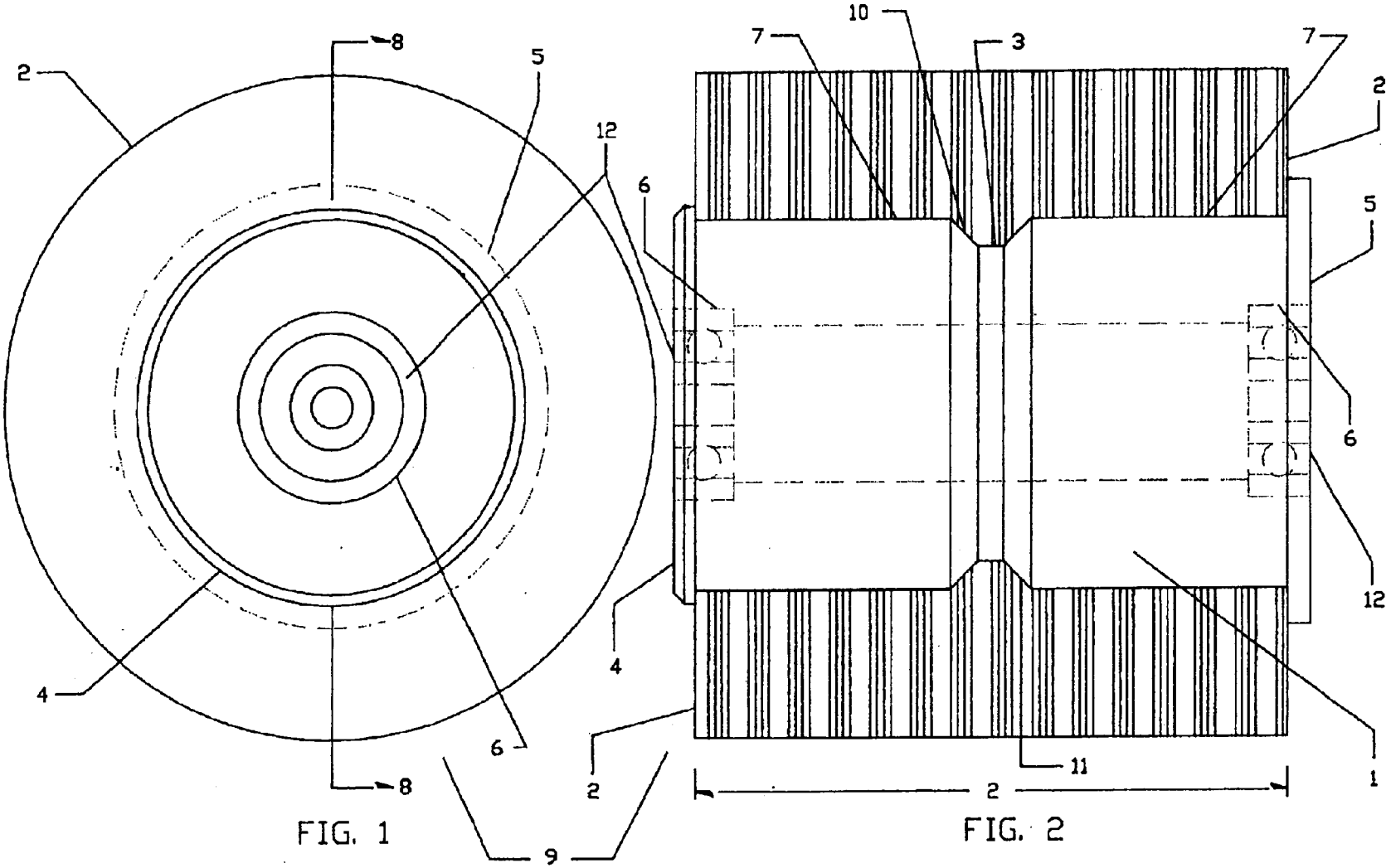
FIG. 1 is an end view of the composite cylinder with section arrows 8—8, only through the core covering.
FIG. 2 is a plan view of the composite cylinder with only the core covering shown in section along the view line 8—8.

With reference to the drawing the in-line wheel, according to the present invention, generally designated by the reference numeral 9, comprises the nylon or equivalent core 1 of the composite roller skating cylinder 9 can be molded from appropriate resin or machined from commercial rod stock. The covering 2 for best results, should be sliced from polyurethane or equivalent tubing stock. The longitudinal appropriate flexible polyurethane tubing section 2 is then forced to fit longitudinally over the series of complex impediments 3, 4, 7, 10 and 11 in the rigid nylon core's 1 outer diameter. The core covering 2 is held in place longitudinally between core 1, impediments 4 and 5.

The diametrical interference fits at 3, 7, 10 and 11 forms a perdurable stationary physical bond between the rigid nylon core 1 and the flexible polyurethane tube section 2. The diametrical impediments 3, 10 and 11 provide an impediment in the core 1 with a resilience which is different from that provided at the two diametrical impediments at 7. This difference in resiliency allows the skater the option of utilizing all or half of the wheels contact surface during any give roller skating dynamic ambulatory maneuver.

The core 1 cavities at 6 encapsulate the outer diameter of anti-friction ball bearings 12. All rotation of the perdurable composite cylinder occurs in the anti-friction ball bearings.

From the above description, it is thus evident that the present invention achieves the intended aim and objects; in particular this embodiment allows the in-line roller skating community to obtain particularly high levels of performance results which can not be found in conventional in-line skate wheel solution. The present invention thus conceived is susceptible of numerous modification and variation, all of which are within the scope and spirit of this inventive concept.

What is claimed is:

1. A composite wheel assembly comprising: a cylinder comprising a central opening therethrough, an annular groove extending around an outer surface thereof, and a pair of impediments at either end of the cylinder, the impediments having a larger diameter than the cylinder; a tire comprising a resilient material and having a length, an outer diameter, and a constant inner diameter opening therethrough; the length of the tire being substantially equal to the length of the outer surface of the cylinder; the time being fitted over the cylinder such that the tire is disposed between the impediments and a central portion of the tire expanding inwardly into the groove of the cylinder to create a series of separate longitudinal lengths of cushioning from one end of the wheel assembly to the other end.

* * * * *